US010349806B2

(12) United States Patent
Buesing

(10) Patent No.: US 10,349,806 B2
(45) Date of Patent: Jul. 16, 2019

(54) DISHWASHER

(71) Applicant: Samsung Electronics Co., Ltd., Gyeonggi-do (KR)

(72) Inventor: Johannes Buesing, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 380 days.

(21) Appl. No.: 15/045,017

(22) Filed: Feb. 16, 2016

(65) Prior Publication Data

US 2016/0235273 A1 Aug. 18, 2016

(30) Foreign Application Priority Data

Feb. 16, 2015 (KR) ..... 10-2015-0023193

(51) Int. Cl.
*A47L 15/42* (2006.01)
*A47L 15/23* (2006.01)
*A47L 15/16* (2006.01)

(52) U.S. Cl.
CPC ..... *A47L 15/4206* (2013.01); *A47L 15/23* (2013.01); *A47L 15/4204* (2013.01); *A47L 15/16* (2013.01); *A47L 15/4221* (2013.01); *A47L 15/4282* (2013.01)

(58) Field of Classification Search
CPC ..... A47L 15/4206
See application file for complete search history.

(56) References Cited

U.S. PATENT DOCUMENTS

| | | | |
|---|---|---|---|
| 2010/0037923 | A1 | 2/2010 | Dingler et al. |
| 2013/0019899 | A1 | 1/2013 | Yoon et al. |
| 2014/0230852 | A1 | 8/2014 | Tuller et al. |
| 2014/0305474 | A1 | 10/2014 | Tempelmann et al. |

FOREIGN PATENT DOCUMENTS

| | | | |
|---|---|---|---|
| EP | 2 517 611 | A1 | 10/2012 |
| EP | 2 554 102 | A2 | 2/2013 |
| EP | 2671496 | A2 | 12/2013 |
| EP | 2818090 | A1 | 12/2014 |
| KR | 10-2007-0080911 | A | 8/2007 |
| KR | 10-2010-0110547 | A | 10/2010 |
| KR | 10-2012-0129259 | A | 11/2012 |

OTHER PUBLICATIONS

Extended European Search Report dated Jun. 15, 2016 in connection with European Patent Application No. 16155855.6, 8 pages.
European Patent Office, "Communication pursuant to Article 94(3) EPC," Application No. EP16155855.6, Jan. 24, 2019, 4 pages.

*Primary Examiner* — Jason Y Ko

(57) ABSTRACT

Disclosed herein is a dishwasher that includes a linear type injection structure with an easily separable filter assembly. The dishwasher includes a washing tub configured to wash dishes, a sump configured to store washing water injected toward the washing tub, and a coarse filter located at a bottom plate of the washing tub and configured to filter foreign substances included in the washing water. Here, the coarse filter includes a first coarse filter including filter holes through which the washing water that drops to the bottom plate passes, and is configured to protrude from the bottom plate of the washing tub, and a second coarse filter located below the first coarse filter.

14 Claims, 11 Drawing Sheets

DISHWASHER

CROSS-REFERENCE TO RELATED APPLICATION AND CLAIM OF PRIORITY

This application is related to and claims the benefit of Korean Patent Application No. 10-2015-0023193, filed on Feb. 16, 2015 in the Korean Intellectual Property Office, the disclosure of which is incorporated herein by reference.

TECHNICAL FIELD

Embodiments of the present disclosure relate to a dishwasher that includes a separable coarse filter.

BACKGROUND

Dishwashers include a body provided with a washing tub, a basket that accommodates dishes, a sump that stores washing water, an injection nozzle that injects the washing water, and a pump that supplies the washing water in the sump to the injection nozzle and washes dishes by injecting the washing water at high pressure to the dishes.

Generally, dishwashers employ a rotor-type injection structure that has a rotating injection nozzle. Rotating nozzles inject washing water while rotating due to water pressure. However, since such rotating nozzles inject the washing water within a range in a radius of rotation, an area to which the washing water is not injected may occur. Accordingly, to prevent the area to which the washing water is not injected, so-called linear type injection structures have been provided.

Linear type injection structures include a fixed nozzle fixed to one side of a washing tub and a vane that moves inside the washing tub and deflects washing water injected from the fixed nozzle, thereby injecting the washing water to overall area of the washing tub according to a movement of a deflecting plate.

The fixed nozzle includes a plurality of injection holes arranged left and right in the washing tub and is fixed to a rear wall of the washing tub. The vane may be provided to extend left and right in the washing tub to deflect the washing water injected from the plurality of injection holes and to linearly reciprocate back and forth in the washing tub.

SUMMARY

To address the above-discussed deficiencies, it is a primary object to provide a dishwasher that includes a linear type injection structure with an easily separable filter assembly.

Additional aspects of the disclosure will be set forth in part in the description that follows and, in part, will be obvious from the description, or is learned by practice of the disclosure.

In accordance with one aspect of the present disclosure, a dishwasher includes a washing tub configured to wash dishes, a sump configured to store washing water injected toward the washing tub, and a coarse filter located at a bottom plate of the washing tub and configured to filter foreign substances included in the washing water. Here, the coarse filter includes a first coarse filter that includes filter holes through which the washing water that drops to the bottom plate passes, and is configured to protrude from the bottom plate of the washing tub, and a second coarse filter located below the first coarse filter.

The second coarse filter is accommodated in a water storage chamber of the sump.

A micro filter capable of filtering foreign substances having smaller sizes than those of foreign substances filtered by the second coarse filter is provided outside the second coarse filter.

The first coarse filter is mounted over the sump.

When the first coarse filter is mounted on the sump, the second coarse filter and the micro filter is pressurized by the first coarse filter to be in close contact with an inside of the sump.

An interference portion is provided on an outside of the first coarse filter while protruding therefrom, and a fixing portion is provided at the sump through bending a side portion thereof inward.

The first coarse filter interferes with the fixing portion, thereby being fixed to the sump.

The interference portion includes a first interference portion and a second interference portion that are provided on opposite outer sides of the first coarse filter, respectively.

The fixing portion includes a first fixing portion corresponding to the first interference portion and a second fixing portion corresponding to the second interference portion.

A mounting portion that protrudes outward is provided on a top of the second coarse filter and is mounted in a top of the micro filter.

A fine filter that includes filter holes having a smaller size than that of the filter holes formed in the first coarse filter is provided in the bottom plate.

The fine filter include a through hole, and the second coarse filter is provided to be inserted in or separated from a water storage chamber of the sump through the through hole.

The fine filter includes a stepped portion formed along a circumference of the through hole.

A mounting portion is provided in the first coarse filter while protruding from an outside thereof, and is mounted on the stepped portion.

The second coarse filter is manufactured using a flexible material.

In accordance with another aspect of the present disclosure, a dishwasher includes a washing tub configured to wash dishes, a sump located below the washing tub and configured to store washing water, and a filter assembly located above the sump and configured to filter foreign substances included in the washing water. Here, the filter assembly includes a fine filter provided parallel to a bottom plate of the washing tub, a first coarse filter that is mounted on the fine filter and includes filter holes that are a larger size than filter holes of the fine filter, a second coarse filter that is cylindrical and is accommodated in the sump and includes filter holes to allow the washing water to pass therethrough, and a micro filter that surrounds an outside of the second coarse filter and includes filter holes that are a smaller size than the filter holes of the second coarse filter.

An interference portion is provided at the first coarse filter while protruding from an outside thereof, and a fixing portion is provided at the sump through bending one side thereof to interfere with the interference portion.

The fine filter includes a through hole, and the first coarse filter passes through the through hole and is coupled with the sump.

The fine filter includes a stepped portion provided around the through hole, and a mounting portion is provided on an outside of the first coarse filter to be mounted on the stepped portion.

The interference portion includes a first interference portion and a second interference portion that are provided on both opposite outer sides of the first coarse filter, respectively.

A diameter of the through hole is smaller than a distance from an end of the first interference portion to an end of the second interference portion.

The first coarse filter includes a pivot portion provided to be inwardly concave.

The first coarse filter is provided to allow the pivot portion to pass through the through hole while pivoting in contact with the fine filter around the through hole.

The pivot portion is located above the interference portion.

When the first coarse filter is mounted in the sump, the second coarse filter and the micro filter is pressurized by the first coarse filter to be fixed not to move.

The second coarse filter is manufactured using a flexible material.

A mounting portion is provided on a top of the second coarse filter and is mounted in a top of the micro filter.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 11, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged device. Hereinafter, a dishwasher in accordance with one embodiment of the present disclosure will be described in detail with reference to the attached drawings.

Figure 1:
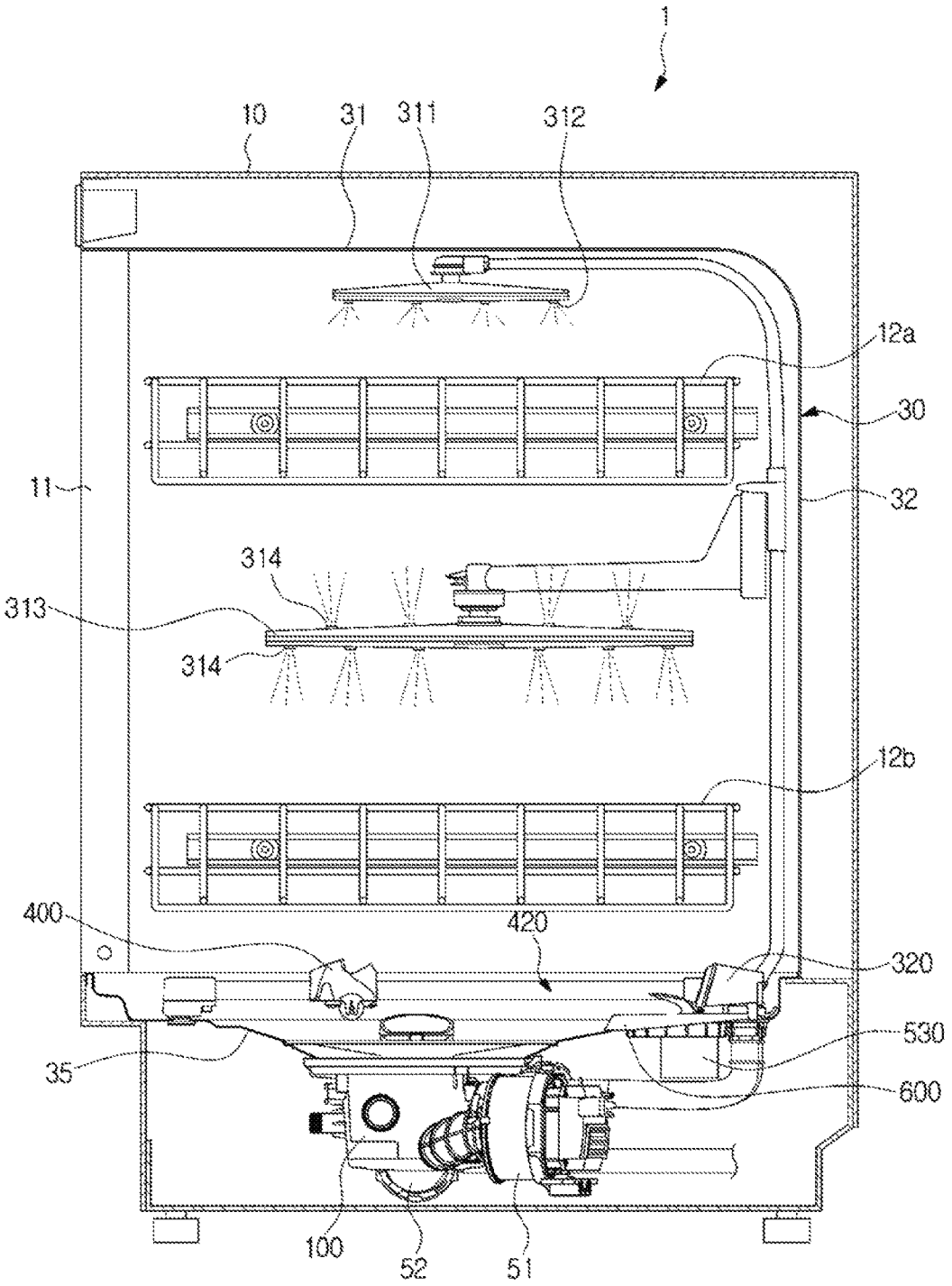
FIG. 1 is a schematic cross sectional view illustrating a dishwasher in accordance with various embodiments of the present disclosure.
Figure 2:
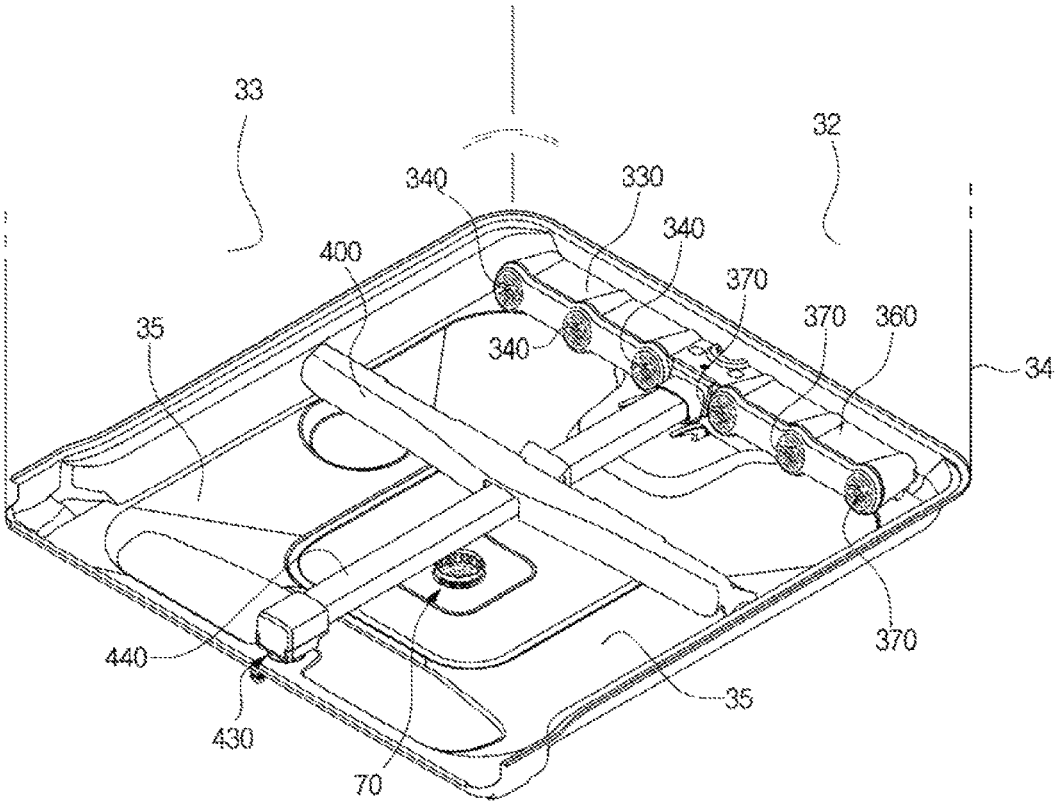
FIG. 2 is a bottom view of the dishwasher of FIG. 1 according to various embodiments of the present disclosure.
Figure 3:
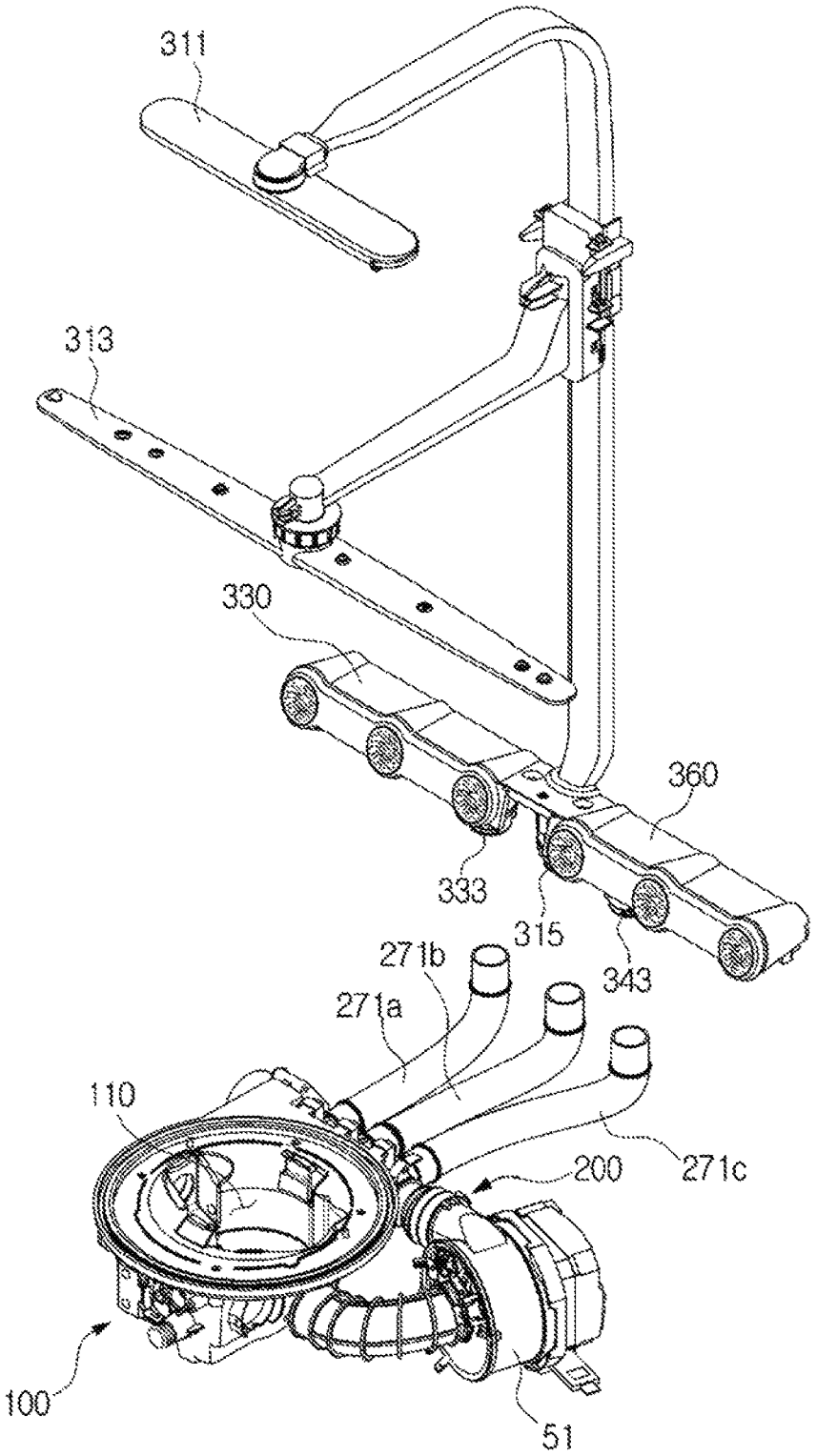
FIG. 3 is a view illustrating a flow channel structure of the dishwasher of FIG. 1 according to various embodiments of the present disclosure.

FIG. 1 is a schematic cross sectional view illustrating the dishwasher in accordance with one embodiment of the present disclosure. FIG. 2 is a bottom view of the dishwasher of FIG. 1. FIG. 3 is a view illustrating a flow channel structure of the dishwasher of FIG. 1.

Referring to FIGS. 1 and 3, the entire structure of a dishwasher 1 in accordance with one embodiment of the present disclosure will be schematically described.

The dishwasher 1 includes a body 10 that forms an external shape, a washing tub 30 provided in the body 10, baskets 12*a* and 12*b* provided in the washing tub 30 to accommodate dishes, injection nozzles 311, 313, and 320 that inject washing water, a sump 100 that stores the washing water, a circulation pump 51 that pumps and supplies the washing water to the injection nozzles 311, 313, and 320, a drainage pump 52 that discharges the washing water together with garbage from the body 10, a vane 400 that deflects the washing water toward the dishes while moving in the washing tub 30, and a driving device 420 that drives the vane 400.

The washing tub 30 may have an approximate box shape with an open front to allow the dishes to be inserted or withdrawn. The open front of the washing tub 30 is opened and closed by a door 11. The washing tub 30 includes an upper wall 31, a rear wall 32, a left wall 33, a right wall 34, and a bottom plate 35.

The baskets 12*a* and 12*b* are wire racks formed of wires to allow the washing water to pass through and not be collected. The baskets 12*a* and 12*b* are detachably provided in the washing tub 30. The baskets 12*a* and 12*b* include an upper basket 12*a* disposed in an upper portion of the washing tub 30 and a lower basket 12*b* disposed in a lower portion of the washing tub 30.

The injection nozzles 311, 313, and 320 wash the dishes by injecting the washing water at high pressure. The injection nozzles 311, 313, and 320 include an upper rotating nozzle 311 provided in the upper portion of the washing tub 30, an intermediate rotating nozzle 313 provided in the middle of the washing tub 30, and a fixed nozzle assembly 320 provided on a bottom of the washing tub 30.

The upper rotating nozzle 311 is provided above the upper basket 12*a* and injects the washing water downward while rotating due to water pressure. For this, in a bottom end of the upper rotating nozzle 311, a plurality of injection holes 312 is provided. The upper rotating nozzle 311 directly injects the washing water toward the dishes stored in the upper basket 12*a*.

The intermediate rotating nozzle 313 is provided between the upper basket 12*a* and the lower basket 12*b* and injects the washing water upward and downward while rotating due to water pressure. For this, in a top end and a bottom end of the intermediate rotating nozzle 313, a plurality of injection holes 314 is provided. The intermediate rotating nozzle 313 directly injects the washing water toward the dishes stored in the upper basket 12*a* and the lower basket 12*b*.

The fixed nozzle assembly 320, unlike the rotating nozzles 311 and 313, is provided to not move, and is fixed to one side of the washing tub 30. The fixed nozzle assembly 320 is disposed approximately adjacent to the rear wall 32 of the washing tub 30, and injects the washing water toward the front of the washing tub 30. Accordingly, the washing water injected by the fixed nozzle assembly 320 may not move directly toward the dishes.

The washing water injected from the fixed nozzle assembly 320 is deflected by the vane 400 toward the dishes. The fixed nozzle assembly 320 is disposed below the lower basket 12*b*, and the vane 400 deflects the washing water injected from the fixed nozzle assembly 320 upward. That is, the washing water injected from the fixed nozzle assembly 320 is deflected by the vane 400 toward the dishes stored in the lower basket 12*b*.

The fixed nozzle assembly 320 includes a plurality of injection holes arranged in the left and right of the washing tub 30, respectively. The plurality of injection holes 340 and 370 inject the washing water forward.

The vane 400 is laterally elongated in the washing tub 30 to deflect all the washing water injected from the plurality of injection holes 340 and 370 of the fixed nozzle assembly 320. One end of the vane 400 is adjacent to the left wall 33 of the washing tub 30, and another end thereof is provided to be adjacent to the right wall 34 of the washing tub 30.

The vane 400 linearly reciprocates in an injection direction of the washing water injected from the fixed nozzle assembly 320. That is, the vane 400 linearly reciprocates back and forth in the washing tub 30.

A linear injection structure that includes the fixed nozzle assembly 320 and the vane 400 wash the whole area of the washing tub 30 without a dead zone. In the case of the rotating nozzles 311 and 313, the washing water is injected within the radius of rotation, which is different from the linear injection structure.

The fixed nozzle assembly 320 includes a left fixed nozzle 330 disposed in the left of the washing tub 30 and a right fixed nozzle 360 disposed in the right of the washing tub 30. Inlets 315, 333, and 343 included in the fixed nozzle assembly 320 are connected to nozzle inlet connection portions 651*a*, 651*b*, and 651*c* included in a bottom plate cover 600. The nozzle inlet connection portions 651*a*, 651*b*, and 651*c* are coupled with hoses 271*a*, 271*b*, and 271*c* that extend from a distribution device 200.

The rotating nozzles 311 and 313 and the fixed nozzle assembly 320 independently inject the washing water. The left fixed nozzle 330 and the right fixed nozzle 360 also independently inject the washing water.

The washing water injected from the left fixed nozzle 330 is deflected by the vane 400 only toward a left area of the washing tub 30. The washing water injected from the right fixed nozzle 360 is deflected by the vane 400 only toward a right area of the washing tub 30.

The dishwasher 1 independently washes the left and right of the washing tub 30. Unlike the embodiment, the washing tub 30 may not only be divided into the left and right, but also is further subdivided as necessary.

Hereinafter, operations and the flow channel structure of the dishwasher 1, a structure of the fixed nozzle assembly 320, and a washing water distribution structure will be described.

The dishwasher 1 includes a water supply operation, a washing operation, a drainage operation, and a drying operation.

During the water supply operation, the washing water is supplied into the washing tub 30 through a water supply pipe (not shown). The washing water supplied to the washing tub 30 flows due to a grade of the bottom plate 35 of the washing tub 30 to be collected in the sump 100 provided at the bottom of the washing tub 30.

During the washing operation, the circulation pump 51 is operated to pump the washing water in the sump 100. The washing water pumped by the circulation pump 51 is distributed to the rotating nozzles 311 and 313, the left fixed nozzle 330, and the right fixed nozzle 360 through the distribution device 200. Due to a pumping force of the circulation pump 51, the washing water is injected from the injection nozzles 311, 313, and 320 at high pressure, thereby washing the dishes.

The upper rotating nozzle 311 and the intermediate rotating nozzle 313 receive the washing water from the distribution device 200 through a second hose 271*b*. The left fixed nozzle 330 receives the washing water from the distribution device 200 through a first hose 271*a*. The right fixed nozzle 360 receives the washing water from the distribution device 200 through a third hose 271*c*.

In the embodiment, the distribution device 200 is configured to have four distribution modes in total.

For example, the distribution device 200 includes a first mode of supplying the washing water only to the rotating nozzles 311 and 313 through the second hose 271*b*, a second mode of supplying the washing water only to the right fixed nozzle 360 through the third hose 271*c*, a third mode of supplying the washing water only to the left fixed nozzle 330 and the right fixed nozzle 360 through the first hose 271*a* and the third hose 271*c*, and a fourth mode of supplying the washing water only to the left fixed nozzle 330 through the first hose 271*a*.

The distribution device 200, unlike the embodiment, is configured to have various further distribution modes.

The washing water injected from the injection nozzles 311, 313, and 320 hits the dishes to remove garbage on the dishes and drops together with the garbage to be collected in the sump 100 again. The circulation pump 51 pumps and circulates the washing water stored in the sump 100 again. During the washing operation, the circulation pump 51 repetitively operates and stops several times. In this process, the garbage that drops together with the washing water to the sump 100 is collected by a filter mounted on the sump 100 and remains in the sump 100 without circulating to the injection nozzles 311, 313, and 320.

During the drainage operation, the drainage pump 52 operates to discharge the washing water together with the garbage that remains in the sump 100 from the body 10.

In the drying operation, a heater (not shown) mounted in the washing tub 30 is operated to dry the dishes.

Figure 4:
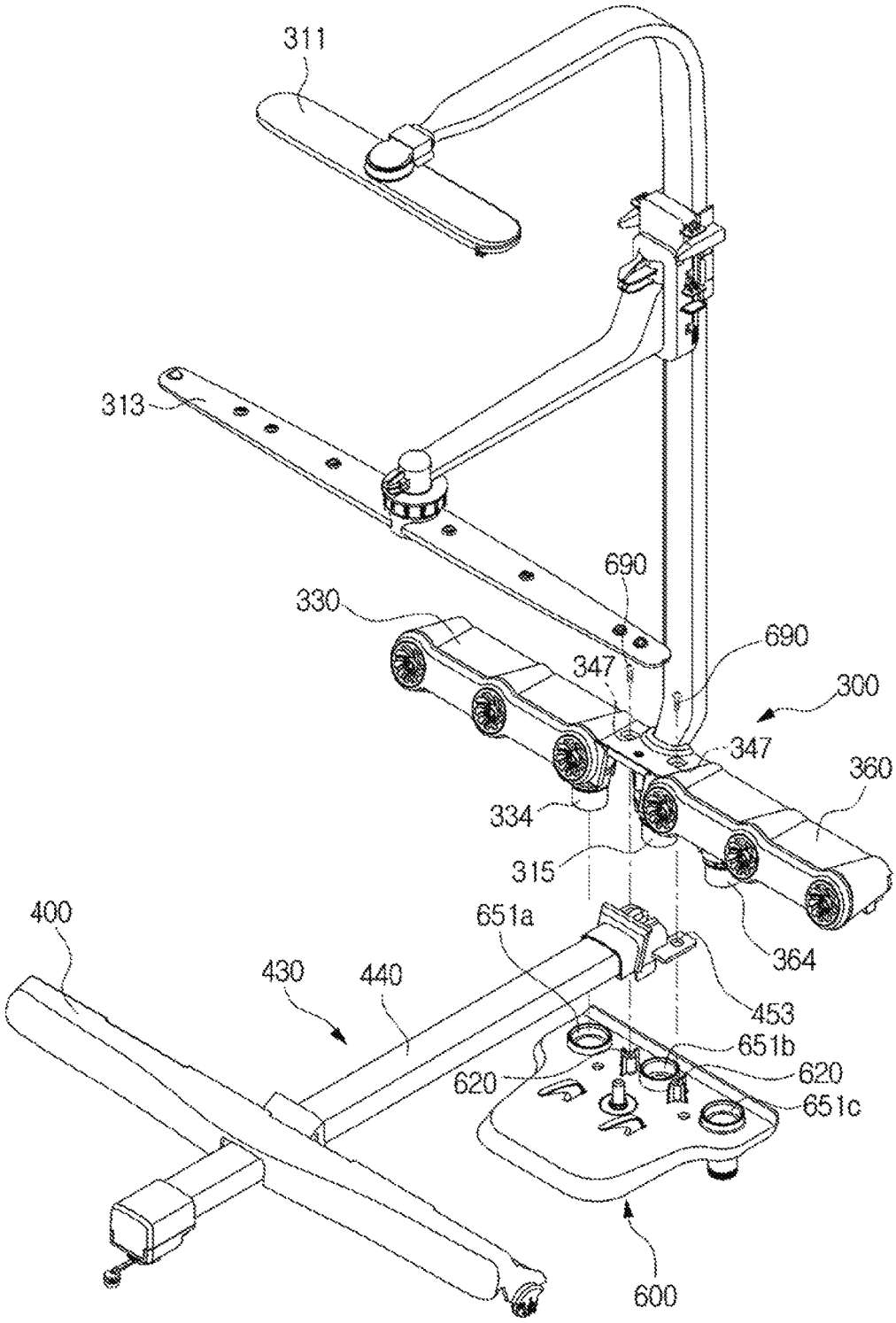
FIG. 4 is an exploded perspective view illustrating a vane, a rail assembly, an injection nozzle assembly, and a bottom plate cover of the dishwasher of FIG. 1 according to various embodiments of the present disclosure.

FIG. 4 is an exploded perspective view illustrating a vane, a rail assembly, an injection nozzle assembly, and a bottom plate cover of the dishwasher of FIG. 1.

Referring to FIG. 4, the dishwasher 1 in accordance with one embodiment of the present disclosure includes the bottom plate cover 600 coupled with a rear one side of the bottom plate 35 of the washing tub 30. The bottom plate cover 600 is coupled with the rail assembly 430 and the nozzle assembly 300. The rail assembly 430 and the nozzle assembly 300 are fixed by fastening members 690. For this, coupling holes 620, 453, and 347 is formed in positions corresponding to the bottom plate cover 600, the rail assembly 430, and the nozzle assembly 300, respectively. Through this structure, the rail assembly 430 and the nozzle assembly 300 is mutually arranged and fixed.

In the dishwasher 1 in accordance with one embodiment of the present disclosure, since the washing water injected from the fixed injection nozzles 320 of the nozzle assembly 300 does not move directly toward the dishes but is deflected by the vane 400 coupled with the rail assembly 430 to move toward the dishes, it is necessary to precisely arrange positions of the fixed injection nozzles 320 and the rail assembly 430, which is satisfied through the coupling structure.

The bottom plate cover 600 seals a motor through hole, a flow channel through hole, etc. formed in the bottom plate 35, supports a motor 530 (refer to FIG. 1) that drives the vane 400, and fixes the rail assembly 430 and the nozzle assembly 300 of the dishwasher 1.

The rail assembly 430 is provided to guide a movement of the vane 400. The rail assembly 430 includes a rail 440 that guides the movement of the vane 400. The rail 440 is provided to extend back and forth in the washing tub 30. For example, the rail 440 is provided to extend back and forth in the middle based on the left wall 33 and the right wall 34 of the washing tub 30. The rail 440 is formed of a metal material.

The rail 440 is formed in a hollow pipe in which a driving device for moving the vane 400 is located. For example, a belt (not shown) that connects the motor 530 with the vane 400 is located in the rail 440. A driving force of the motor 530 is transferred to the vane 400 through the belt, thereby allowing the vane 400 to move back and forth along the rail 440.

Figure 5:
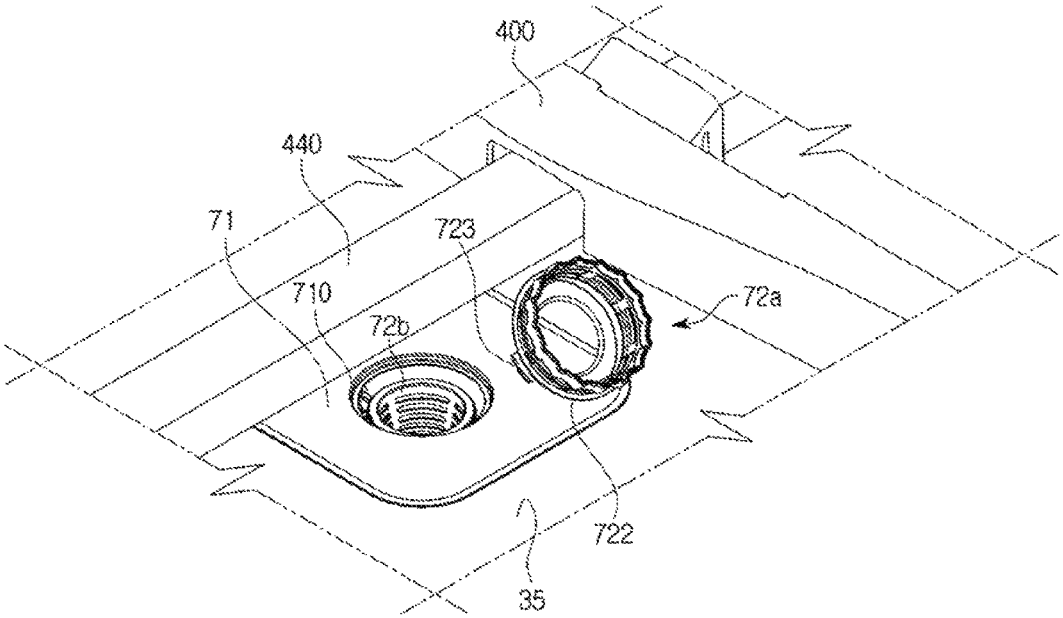
FIG. 5 is an exploded perspective view of a filter assembly in accordance with various embodiments of the present disclosure.
Figure 6:
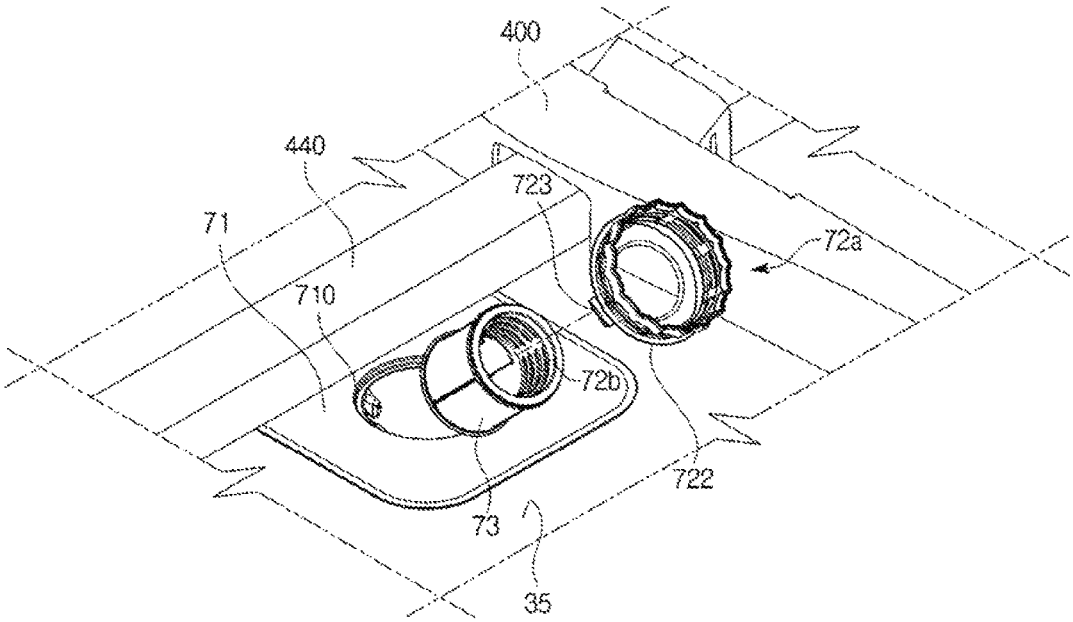
FIG. 6 is a cross-sectional view of the filter assembly in accordance with various embodiments of the present disclosure.
Figure 7:
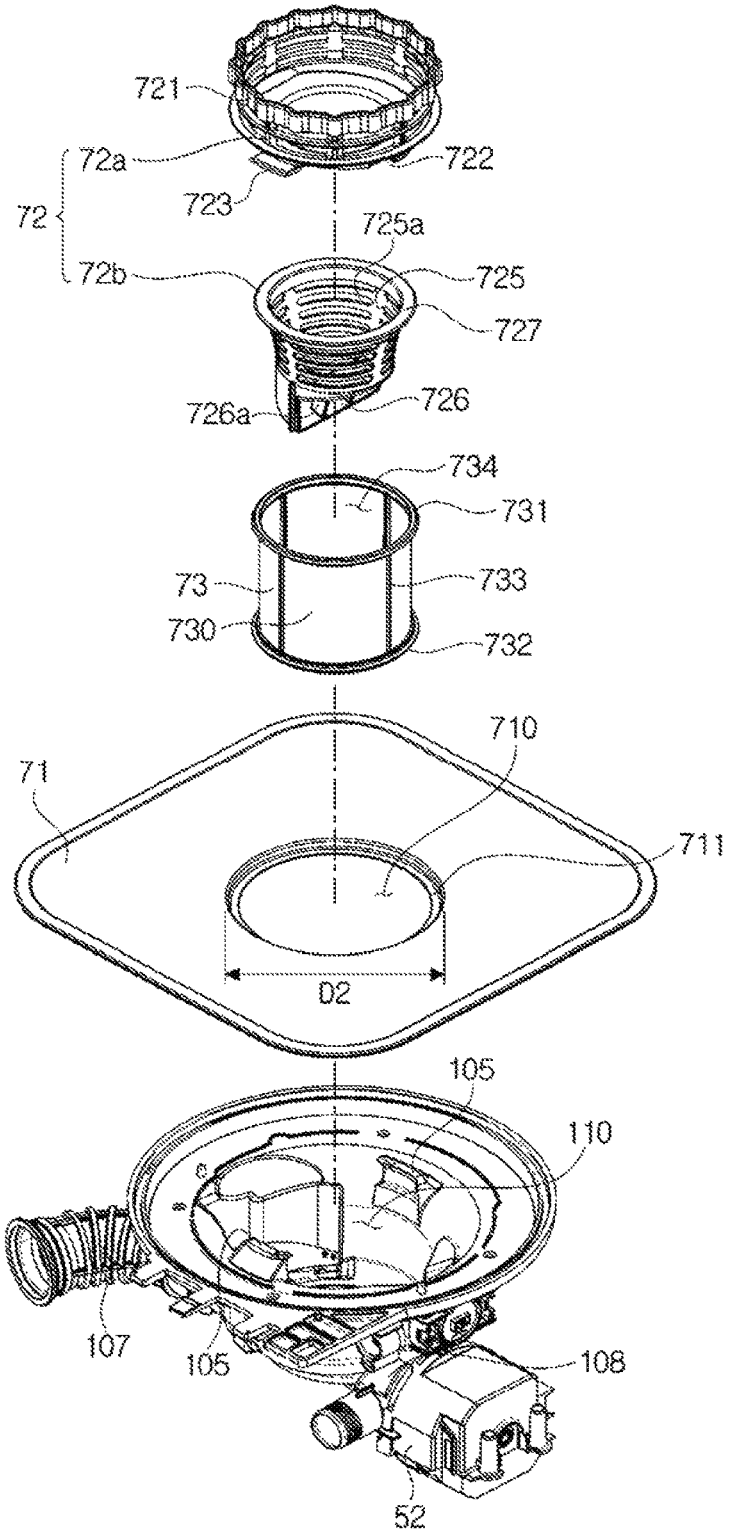
FIG. 7 is a partial cross-sectional view of the filter assembly in accordance with various embodiments of the present disclosure.

FIG. 5 is an exploded perspective view of a filter assembly in accordance with one embodiment of the present disclosure. FIG. 6 is a cross-sectional view of the filter assembly in accordance with one embodiment of the present disclosure. FIG. 7 is a partial cross-sectional view of the filter assembly in accordance with one embodiment of the present disclosure.

Hereinafter, referring to FIGS. 5 to 7, a configuration of a filter assembly 70 included in the dishwasher 1 in accordance with one embodiment of the present disclosure will be described.

The dishwasher 1 in accordance with one embodiment of the present disclosure includes the sump 100 that stores the washing water and the filter assembly 70 mounted in the sump 100 to filter the garbage included in the washing water. As shown in FIG. 2, the filter assembly 70 is provided in the center of the bottom plate 35. When the rail 440 extends back and forth from the center of the washing tub 30, the filter assembly 70 is located below the rail 440.

The sump 100 is formed in a hemispherical shape with an open top side. The open top side of the sump 100 is located toward a drain of the bottom plate 35. The sump 100 includes a bottom portion 101, a sidewall portion 103, a water storage chamber 110 faulted in the bottom portion 101 and the sidewall portion 103 to store the washing water, a circulation port 107 to which the circulation pump 51 is connected, and a drainage port 108 to which the drainage pump 52 is connected.

The filter assembly 70 is mounted in the open top side of the sump 100. To guide the washing water toward the drain using a self load, the bottom plate 35 of the washing tub 30 includes a slope toward the drain. The washing water that drops to the bottom plate 35 flows into the sump 100 through the drain.

The filter assembly 70 includes a fine filter 71 mounted in the drain of the bottom plate 35 and a coarse filter 72 and a micro filter 73 mounted in the sump 100.

The fine filter 71 is approximately horizontally mounted above the drain of the bottom plate 35 of the washing tub 30. The fine filter 71 includes a filter portion 71 that filters the garbage and a through hole 710 through which the coarse filter 72 passes. The through hole 710 is provided in a center of the fine filter 71. A stepped portion 711 is provided around the through hole 710.

The coarse filter 72 is provided to filter garbage having a relatively large size, compared with the fine filter 71. The coarse filter 72 includes a first coarse filter 72*a* and a second coarse filter 72*b*. The first coarse filter 72*a* and the second coarse filter 72*b* are separably provided. The first coarse filter 72*a* is located above the second coarse filter 72*b*. The first coarse filter 72*a* and the second coarse filter 72*b* have approximately cylindrical shapes.

The first coarse filter 72*a* is manufactured using a stiff material. The second coarse filter 72*b* is formed of the same material as that of the first coarse filter 72*a* or is manufactured using a flexible material such as rubber or silicone. When the second coarse filter 72*b* is formed of the flexible material, it is easy to extract the second coarse filter 72*b* from the sump 100.

The first coarse filter 72*a* is located to protrude upward from the fine filter 71. The first coarse filter 72*a* that protrudes from the fine filter 71 is formed by a filter frame 721, and a plurality of filter holes 721*a* is formed in the filter frame 721 to allow the washing water from which the garbage having the relatively large size is filtered to pass therethrough. The filter frame 721 is formed by elongating a plurality of ribs to intersect with one another.

A mounting portion 722 and an interference portion 723 are provided to protrude from an outside of the first coarse filter 72*a*. The interference portion 723 is provided below the mounting portion 722 while being spaced at a certain interval therefrom. A pivot portion 724 concave toward an inside of the first coarse filter 72*a* is provided on at least a part of a sidewall of the first coarse filter 72*a* located between the mounting portion 722 and the interference portion 723. The interference portion 723 is provided on both outsides of the first coarse filter 72*a* opposite to each other. When the first coarse filter 72*a* is mounted in the fine filter 71, the mounting portion 722 is mounted in the stepped portion 711 formed on the fine filter 71.

When the first coarse filter 72*a* is mounted in the fine filter 71, the interference portion 723 interferes with a fixing portion 105 formed on one side of the sump 100. The fixing portion 105 is formed by bending a part of the sidewall portion 103 of the sump 100 inward. The interference portion 723 interferes with the fixing portion 105, thereby fixing the first coarse filter 72*a*.

The mounting portion 722 is provided to protrude from the outside of the first coarse filter 72*a* while being formed in a ring shape corresponding to the stepped portion 711 provided around the through hole 710. The interference portion 723 is provided not to surround the whole outside of the first coarse filter 72*a*.

The second coarse filter 72*b* is inserted into the water storage chamber 110 of the sump 100 through the through hole 710 to be located therein. The second coarse filter 72*b* is formed by a filter frame 725 provided to filter the garbage having the relatively large size. The filter frame 725 includes a plurality of filter holes 725*a* to allow the washing water that flows into the second coarse filter 72*b* to pass therethrough.

The second coarse filter 72*b* includes an opening 726 formed toward one side. In the opening 726, a filter rib 726*a* is provided to filter foreign substances. The filter rib 726*a* is disposed across the opening 726. Foreign substances having a large size included in the washing water that passes through the opening 726 is filtered by the filter rib 726*a*.

Foreign substances that pass through the opening 726 are collected in the water storage chamber 110 of the sump 100. Foreign substances collected in the water storage chamber 110 are discharged outward through the drainage port 108. The second coarse filter 72*b* is located to allow a sidewall in which the opening 726 is not formed to face the circulation port 107.

The micro filter 73 is located outside the coarse filter 72. The micro filter 73 is formed in an approximately cylindrical shape to surround an outer circumferential surface of the second coarse filter 72*b*. The micro filter 73 includes a filter portion 730 provided to filter garbage having a relatively small size and frames 731, 732, and 733 that support the filter portion 730. The frames 731, 732, and 733 include first and second frames 731 and 732 provided above and below the filter portion 730, respectively, and a plurality of third frames 733 vertically elongated to connect the first frame 731 with the second frame 732. When the micro filter 73 has a cylindrical shape, the first and second frames 731 and 732 are formed in a ring shape.

The second coarse filter 72*b* is located in an accommodating portion 734 that is an inner space of the filter portion 730. Foreign substances having relatively small sizes included in the washing water that passes through the filter holes 725*a* of the second coarse filter 72*b* is filtered by the filter portion 730 of the micro filter 73. The foreign substances filtered by the micro filter 73 are collected in the water storage chamber 110 in the sump 100. The foreign substances collected in the water storage chamber 110 are discharged outward through the drainage port 108.

Meanwhile, to prevent the foreign substances collected in the water storage chamber 110 from moving toward the circulation port 107 through a space between the micro filter 73 and an inner wall of the sump 100, the micro filter 73 is in close contact with the bottom portion 101 and the sidewall portion 103 of the sump 100.

To allow the bottom portion 101 and the sidewall portion 103 of the sump 100 to be in close contact with the micro filter 73, one of a sealing protrusion and a sealing groove is provided at the second frame 732 and the third frame 733 of the micro filter 73 and the other of the sealing protrusion and the sealing groove is provided at the bottom portion 101 and the sidewall portion 103 of the sump 100 to allow the sealing protrusion to be inserted into the sealing groove.

The water storage chamber 110 is divided by the micro filter 73 into a garbage collection chamber 111 and a circulation chamber 112. The drainage pump 52 is connected to the garbage collection chamber 111, and the circulation pump 51 is connected to the circulation chamber 112. A bottom of the second coarse filter 72*b* is provided toward the garbage collection chamber 111. The washing water that passes through the second coarse filter 72*b* and the foreign substances included in the washing water flows into the garbage collection chamber 111.

The washing water that flows into the garbage collection chamber 111 passes through the micro filter 73 and flows into the circulation chamber 112. However, since the foreign substances that flow into the garbage collection chamber 111 cannot pass through the micro filter 73, the foreign substances cannot flow to the circulation chamber 112 and remain in the garbage collection chamber 111. The foreign substances collected in the garbage collection chamber 111 are discharged together with the washing water from the body 10.

The rail 440 on which the vane 400 is mounted to move extends back and forth in the washing tub 30. The drain is provided in the bottom plate 35 of the washing tub 30, and the sump 100 is provided below the drain. The filter assembly 70 is mounted in the drain. The washing water that flows into the drain is filtered by the filter assembly 70 to remove the foreign substances therefrom and is pumped by the circulation pump 51 to be reused.

As the dishwasher 1 is used, the foreign substances accumulate in the filter assembly 70. To allow the washing water to smoothly pass through the filter assembly 70, when the foreign substances accumulate in the filter assembly 70 to a certain degree, it is necessary for a user to remove the foreign substances in the filter assembly 70.

The filter assembly 70 in accordance with one embodiment of the present disclosure is formed in a cylindrical shape to maximally increase an area of the coarse filter 72 through which the washing water passes. The coarse filter 72 includes a vertically elongated cylindrical shape. The coarse filter 72 is provided as the cylindrical shape, thereby increasing the area of the coarse filter 72 compared with a plate shape to allow the washing water to smoothly flow into the sump 100 through filter holes having a large size formed in the coarse filter 72.

Since the coarse filter 72 in accordance with one embodiment of the present disclosure includes the first coarse filter 72*a* and the second coarse filter 72*b* that are separable, even though the rail 440 is located above the filter assembly 70, the first coarse filter 72*a* is separated first and then the second coarse filter 72*b* is easily extracted from the sump 100. As described above, since the coarse filter 72 is separably provided, even though the coarse filer 72 has a longer cylindrical shape than that of a general coarse filter, the coarse filter 72 is separated without interfering with the rail 440.

Accordingly, according to one embodiment of the present disclosure, the area of the coarse filter 72 is increased to allow the washing water to easily pass through the filter assembly 70. In the linear type dishwasher 1 that includes the vane 400 moving along the rail 440, even though the rail 440 is located above the filter assembly 70, the filter assembly 70 is easily separated.

Hereinafter, an operation of mounting or separating the filter assembly 70 in the bottom plate 35 of the washing tub 30 will be described. The fine filter 71 is fixed to the bottom plate 35 of the washing tub 30. The through hole 710 formed in the fine filter 71 is located below the rail 440.

Figure 8:
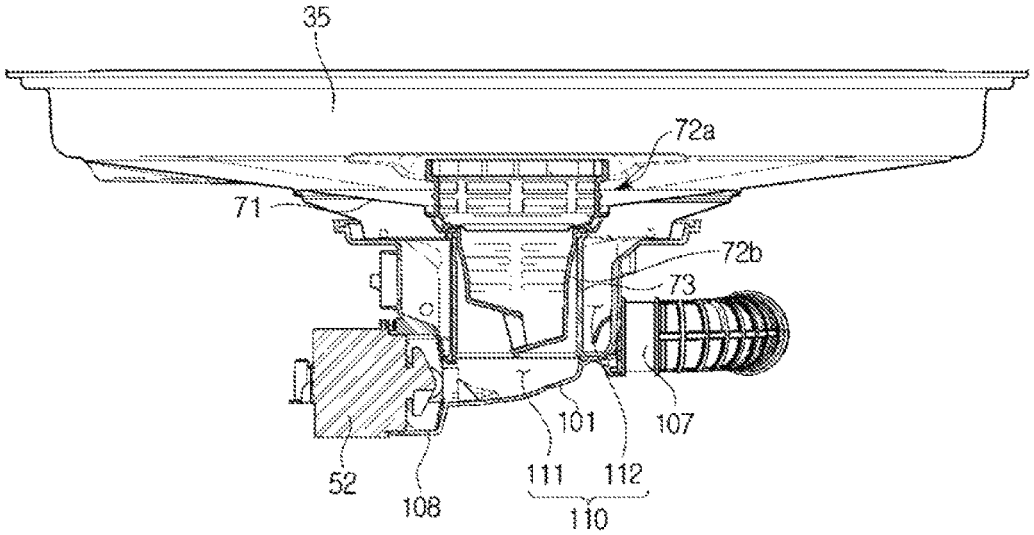
FIG. 8 is a view of a first coarse filter separated from a body in accordance with one embodiment of the present disclosure.
Figure 9:
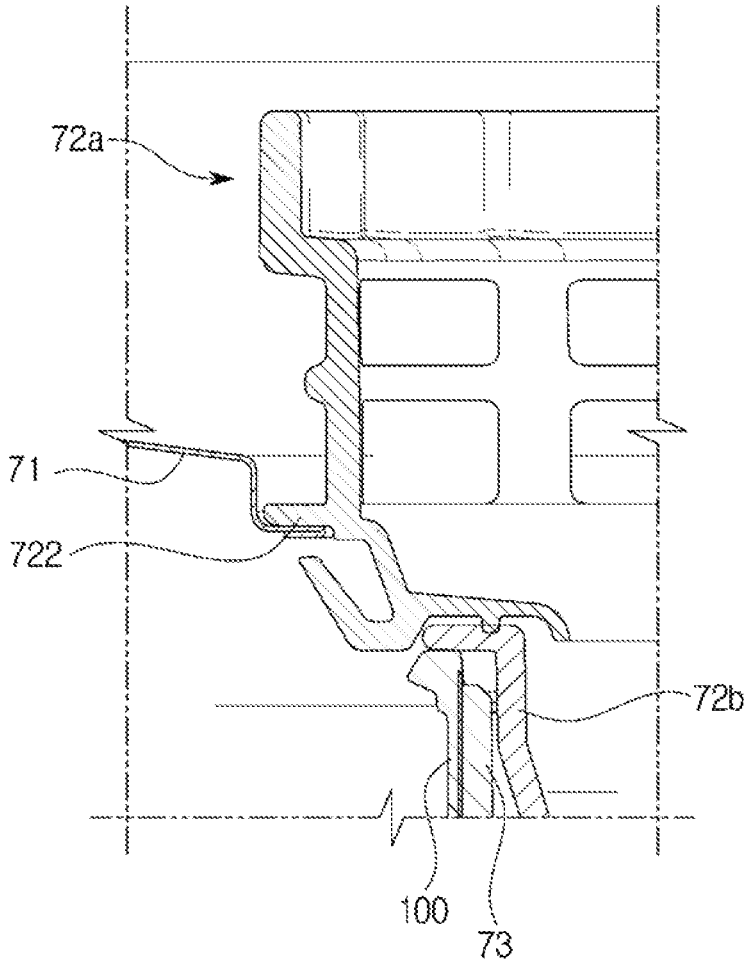
FIG. 9 is a view of a coarse filter and a micro filter separated from the body in accordance with various embodiments of the present disclosure.
Figure 10:
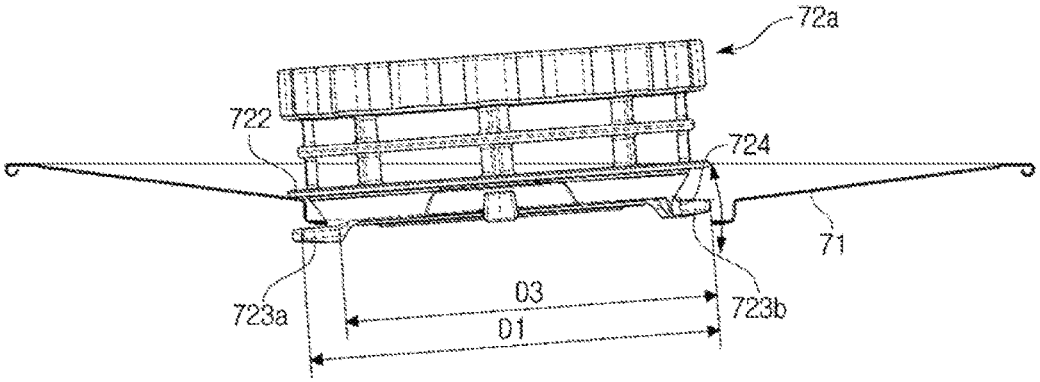
FIGS. 10 and 11 are views illustrating a state of mounting the first coarse filter in accordance with various embodiments of the present disclosure.
Figure 11:
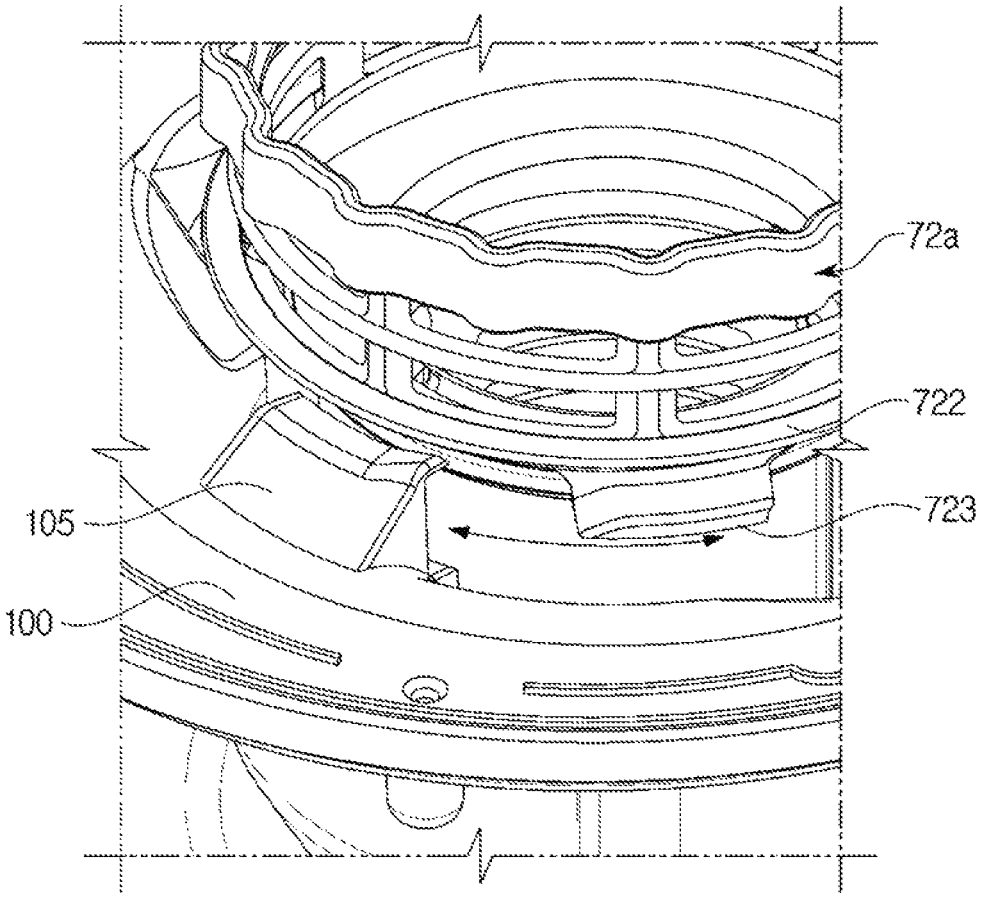

FIG. 8 is a view of the first coarse filter separated from the body in accordance with one embodiment of the present disclosure. FIG. 9 is a view of the coarse filter and the micro filter separated from the body in accordance with one embodiment of the present disclosure. FIGS. 10 and 11 are views illustrating a state of mounting the first coarse filter in accordance with one embodiment of the present disclosure.

Referring to FIGS. 8 to 11, to mount the filter assembly 70 in accordance with one embodiment of the present disclosure in the washing tub 30, first, the micro filter 73 is inserted in the water storage chamber 110 of the sump 100 through the through hole 710. After the micro filter 73 is inserted in the sump 100, the second coarse filter 72*b* is inserted in the micro filter 73. A mounting portion 727 that protrudes outward is provided above the second coarse filter 72*b* and is mounted on the first frame 731 of the micro filter 73. The mounting portion 727 is provided to cover the whole top side of the first frame 731. The second coarse filter 72*b* is inserted in the micro filter 73, and then is inserted together with the micro filter 73 in the sump 100.

After the micro filter 73 and the second coarse filter 72*b* are inserted in the sump 100, the first coarse filter 72*a* is mounted. The interference portion 723 of the first coarse filter 72*a* is inserted through the through hole 710 and may interfere with the fixing portion 150 provided at the sump 100.

Here, when interference portions 723 provided on both outsides of the first coarse filter 72*a* are referred to as a first interference portion 723*a* and a second interference portion 723*b*, a diameter from an end of the first interference portion 723*a* to an end of the second interference portion 723*b* is referred to as D1. The diameter D1 is greater than a diameter D2 of the through hole 710 formed in the fine filter 71. The pivot portion 724 that is an inwardly concave portion of the sidewall of the first coarse filter 72*a* is provided between the mounting portion 722 and the interference portion 723 of the first coarse filter 72*a*.

A shortest distance D3 from the end of the second interference portion 723*b* to the pivot portion 724 is identical to or smaller than the diameter D2 of the through hole 710. After the first interference portion 723*a* is inserted through the through hole 710, when the first coarse filter 72*a* is rotated around the pivot portion 724, the second interference portion 723*b* passes through the through hole 710. The first coarse filter 72*a* rotates while the pivot portion 724 is in contact with an inside of the through hole 710 of the fine filter 71.

The mounting portion 722 of the first coarse filter 72*a* is mounted on the stepped portion 711 of the fine filter 71. After the first interference portion 723*a* and the second interference portion 723*b* pass through the through hole 710, the first coarse filter 72*a* is rotated clockwise or counterclockwise to allow the interference portion 723 to interfere with the fixing portion 105 provided at the sump 100. When the first coarse filter 72*a* is fixed by the fixing portion 105 of the sump 100, the second coarse filter 72*b* and the micro filter 73 is pressurized. The second coarse filter 72*b* and the micro filter 73 are pressurized, thereby improving a seal between the inside of the sump 100 and the filter assembly 70.

To separate the filter assembly 70 from the bottom plate 35 of the washing tub 30, the mounting of the filter assembly 70 is performed in reverse order. The first coarse filter 72*a* is rotated clockwise or counterclockwise to release a state of fixing the interference portion 723 to the fixing portion 105 of the sump 100. When releasing the state of fixing the interference portion 723, the first coarse filter 72*a* is rotated around the pivot portion 724 while the pivot portion 724 is in contact with the inside of the fine filter 71 that forms the through hole 710. One of the first interference portion 723*a* and the second interference portion 723*b* passes through the through hole 710 first, and then the other passes through the through hole 710.

As described above, after the first coarse filter 72*a* is separated, the second coarse filter 72*b* and the micro filter 73 may be separated. Since the second coarse filter 72*b* and the micro filter 73 are separated after the first coarse filter 72*a* is separated, even though the rail 440 is located above the filter assembly 70, the second coarse filter 72*b* and the micro filter 73 are easily separated while avoiding the rail 440.

As described above, according to one embodiment of the present disclosure, the coarse filter 72 has the long cylindrical shape, thereby fully providing the area of the coarse filter 72. As the area of the coarse filter 72 increases, when the fine filter 71 is blocked with foreign substances, the washing water flows in the sump 100 through the coarse filter 72, and the circulation of the washing water may not be interrupted. Also, since the coarse filter 72 is provided to be separable into the first coarse filter 72*a* and the second coarse filter 72*b*, even though the coarse filter 72 has a relatively larger size than a general coarse filter, the coarse filter 72 is easily separated while avoiding the rail 440 located above the filter assembly 70.

As is apparent from the above description, a filter assembly in accordance with one embodiment of the present disclosure is separable to easily remove foreign substances in the filter assembly. An area of a coarse filter is widened, thereby improving filtering performance of the coarse filter. Also, a coupling structure of the filter assembly is modified to improve sealing performance.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A dishwasher comprising:

a washing tub configured to wash dishes;

a sump configured to store washing water injected toward the washing tub;

a fine filter provided in a bottom plate of the washing tub and including a through hole and a stepped portion formed along a circumference of the through hole;

a first coarse filter mounted on the stepped portion and having filter holes that are a larger size than filter holes of the fine filter;

a second coarse filter accommodated in the sump and located below the first coarse filter; and a micro filter surrounding an outside of the second coarse filter and having filter holes that are a smaller size than the filter holes of the second coarse filter, and wherein the first coarse filter is separated from the second coarse filter to prevent the second coarse filter from interfering with the first coarse filter when the second coarse filter is separated from the sump through the through hole.

2. The dishwasher of claim 1, wherein the second coarse filter is accommodated in a water storage chamber of the sump.

3. The dishwasher of claim 2, wherein the micro filter is configured to filter foreign substances comprising smaller sizes than those of foreign substances filtered by the second coarse filter.

4. The dishwasher of claim 3, wherein the first coarse filter is mounted over the sump.

5. The dishwasher of claim 4, wherein when the first coarse filter is mounted on the sump, the second coarse filter and the micro filter are pressurized by the first coarse filter to be in close contact with an inside of the sump.

6. The dishwasher of claim 4, wherein an interference portion is provided on an outside of the first coarse filter while protruding therefrom, and a fixing portion is provided at the sump through bending a side portion thereof inward.

7. The dishwasher of claim 6, wherein the first coarse filter is configured to interfere with the fixing portion, thereby being fixed to the sump.

8. The dishwasher of claim 6, wherein the interference portion comprises a first interference portion and a second interference portion that are provided on opposite outer sides of the first coarse filter, respectively.

9. The dishwasher of claim 8, wherein the fixing portion comprises a first fixing portion corresponding to the first interference portion and a second fixing portion corresponding to the second interference portion.

10. The dishwasher of claim 3, wherein a mounting portion that protrudes outward is provided on a top of the second coarse filter and is mounted in a top of the micro filter.

11. The dishwasher of claim 1, wherein the first coarse filter is configured to protrude upward from the fine filter, and the second coarse filter is located below the fine filter.

12. The dishwasher of claim 1, wherein the second coarse filter is provided to be inserted in or separated from a water storage chamber of the sump through the through hole.

13. The dishwasher of claim 1, wherein a mounting portion is provided in the first coarse filter while protruding from an outside thereof, and is mounted on the stepped portion.

14. The dishwasher of claim 1, wherein the second coarse filter is manufactured using a flexible material.

* * * * *